US007229241B2

(12) United States Patent
Solomon et al.

(10) Patent No.: US 7,229,241 B2
(45) Date of Patent: Jun. 12, 2007

(54) AUTOMATIC PRINTING PLATE FEEDING SYSTEM

(75) Inventors: Yehuda Barnes Solomon, Rishon Lezion (IL); Pavel Korolik, Petah-Tiqwa (IL)

(73) Assignee: Kodak IL Ltd., Petach Tikva (IL)

( * ) Notice: Subject to any disclaimer, the term of this patent is extended or adjusted under 35 U.S.C. 154(b) by 0 days.

(21) Appl. No.: 11/200,241

(22) Filed: Aug. 10, 2005

(65) Prior Publication Data

US 2006/0071353 A1 Apr. 6, 2006

Related U.S. Application Data

(62) Division of application No. 10/185,722, filed on Jul. 1, 2002, now abandoned.

(51) Int. Cl.
*B65H 3/44* (2006.01)

(52) U.S. Cl. ..... 414/416.07; 414/806

(58) Field of Classification Search ..... 414/416.07, 414/797, 806, 900, 929; 271/9.01, 9.07, 271/107
See application file for complete search history.

(56) References Cited

U.S. PATENT DOCUMENTS 4,212,263 A 7/1980 Hillhouse
4,483,527 A 11/1984 Hashimoto et al.
4,539,794 A * 9/1985 Azzaroni ..... 53/493
4,667,948 A 5/1987 Angelbeck et al.
4,878,799 A 11/1989 Seto et al.
4,984,260 A 1/1991 Koyama
5,176,081 A 1/1993 Buus
5,284,334 A * 2/1994 Yamamoto ..... 271/107
5,294,101 A * 3/1994 Scheufler ..... 271/9.01
5,367,360 A 11/1994 McIlwrath et al.
5,368,284 A 11/1994 Renth
5,488,906 A 2/1996 Iron et al.
5,655,452 A 8/1997 Blake et al.
5,738,014 A 4/1998 Rombult et al.
5,771,794 A 6/1998 Benizri et al.
5,785,309 A 7/1998 Halup et al.
5,788,455 A 8/1998 Krupica et al.
5,791,250 A 8/1998 Blake et al.
5,809,360 A 9/1998 Blake et al.
5,992,324 A 11/1999 Rombult et al.
6,000,337 A 12/1999 Blake et al.
6,042,101 A * 3/2000 Menard et al. ..... 271/10.01
6,164,637 A 12/2000 Harari (Continued)

FOREIGN PATENT DOCUMENTS

DE 38 28 439 C2 3/1992

(Continued)

*Primary Examiner*—Charles A. Fox
(74) *Attorney, Agent, or Firm*—David A. Cordeiro

(57) ABSTRACT

An automatic plate feeding system for loading plates of various sizes into a printing plate imaging device, which includes a plurality of trays staggered one on top of the other is provided. At least two of the trays contain plates of different sizes stacked with their sensitive side downward. Separation papers are interposed between the plates. The automatic plate feeding system includes suction cups, which touch the non-sensitive surface of the plate, and a loading mechanism for loading plates from the trays and feeding the loaded plates to the imaging device.

7 Claims, 13 Drawing Sheets

U.S. PATENT DOCUMENTS

| | | | | |
|---|---|---|---|---|
| 6,289,650 | B1 * | 9/2001 | Usui et al. | 53/381.1 |
| 2004/0112233 | A1 * | 6/2004 | Shibabuki et al. | 101/477 |

FOREIGN PATENT DOCUMENTS

| | | | |
|---|---|---|---|
| DE | 41 05 269 | C1 | 9/1992 |
| DE | 40 38 544 | C2 | 12/1992 |
| EP | 0 900 752 | B1 | 7/2002 |
| EP | 1 343 046 | A2 | 9/2003 |
| JP | 62-215444 | A | 9/1997 |

* cited by examiner

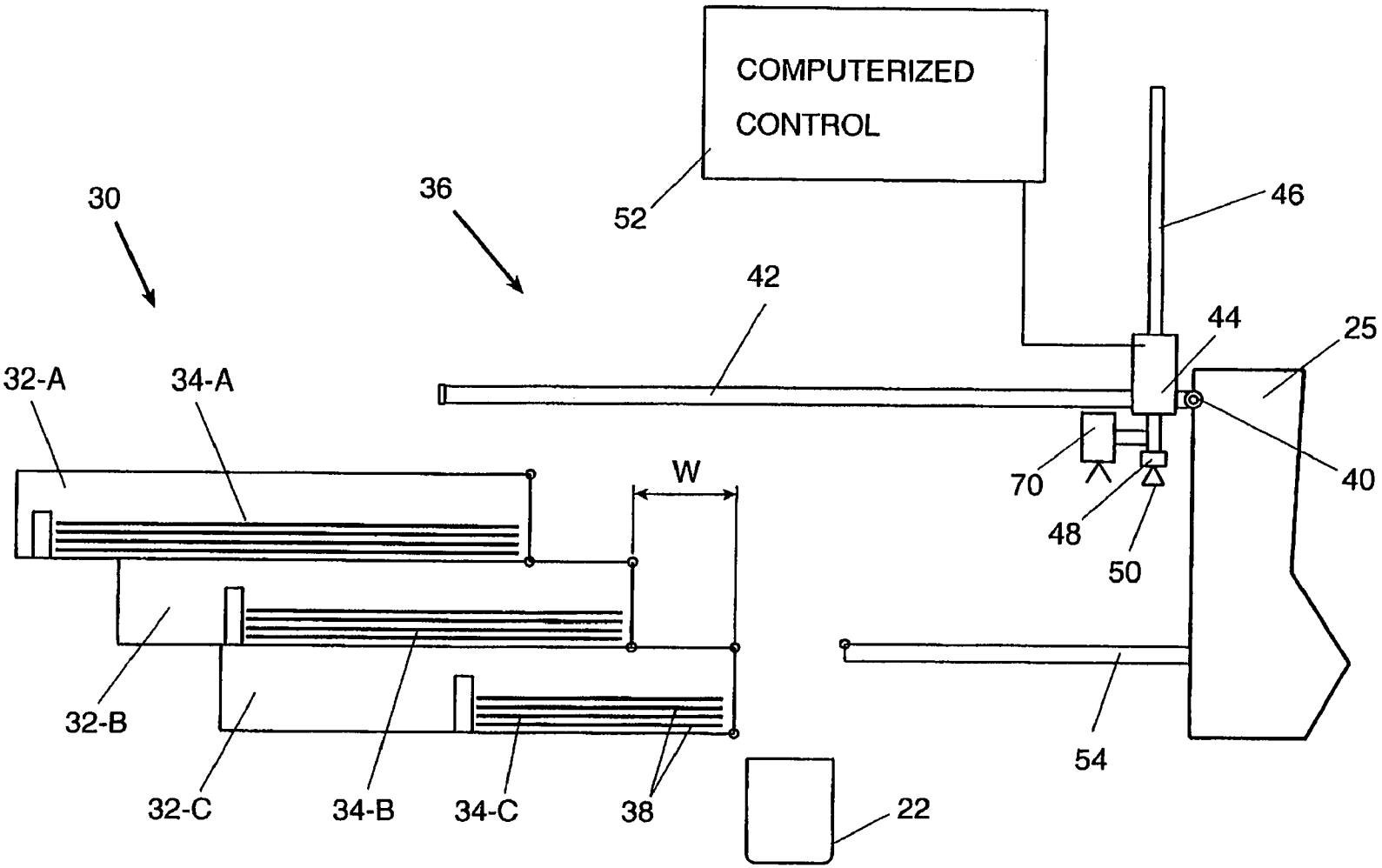
FIG.2-A

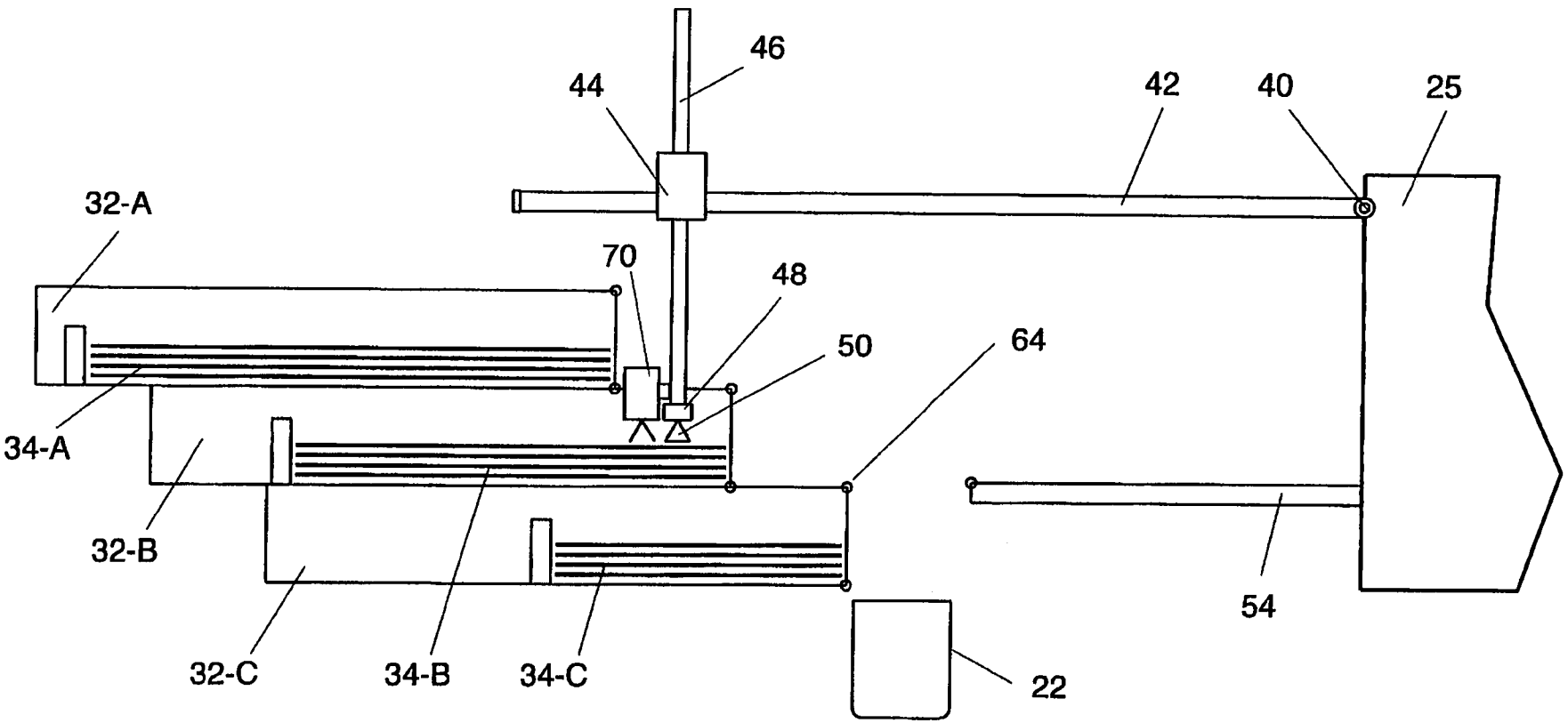
FIG.2-B

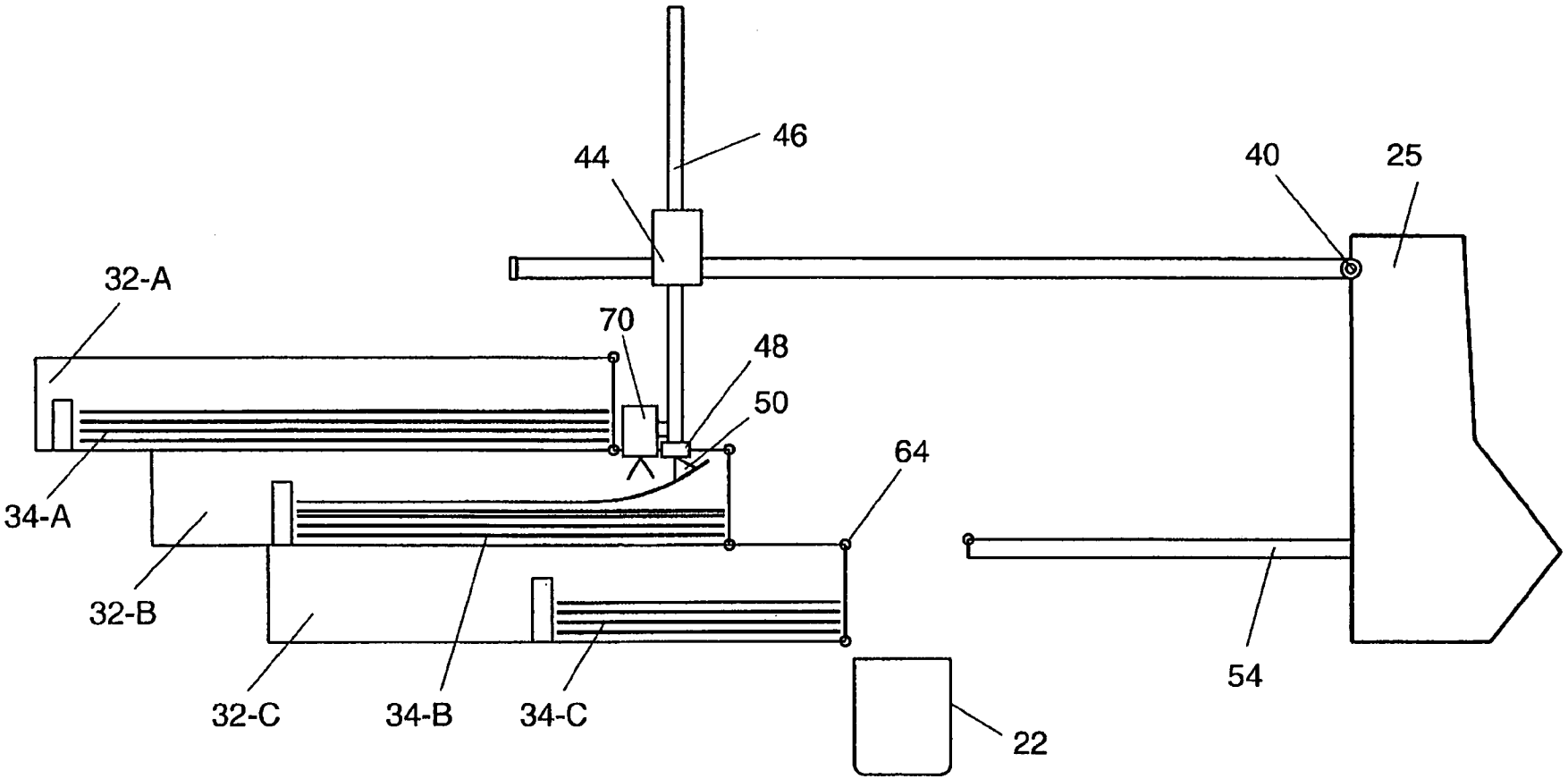
FIG.2-C

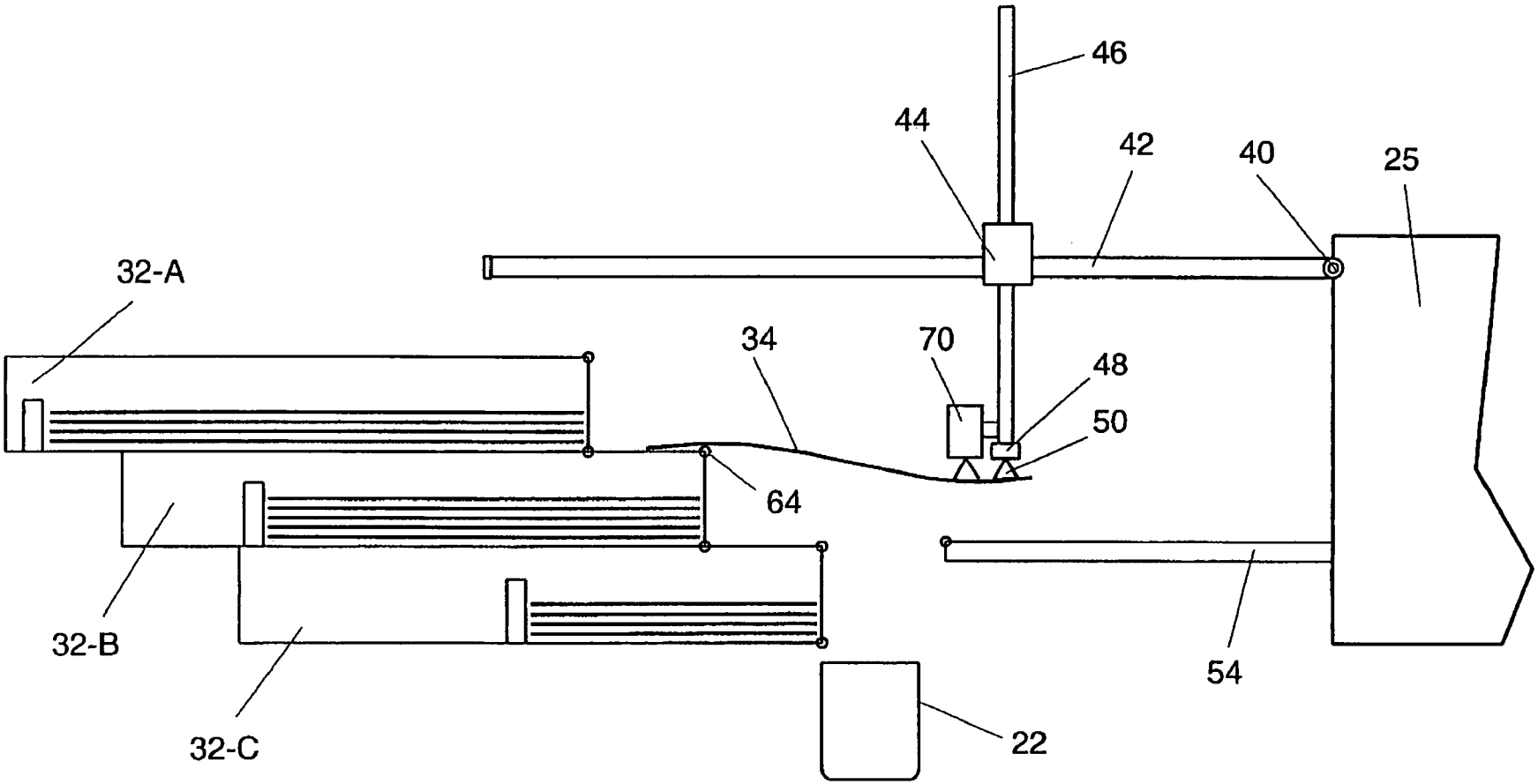
FIG.2-D

AUTOMATIC PRINTING PLATE FEEDING SYSTEM

CROSS REFERENCE TO RELATED APPLICATIONS

"The present application is a divisional application which takes priority from U.S. patent application Ser. No. 10/185,722, filed Jul. 1, 2002 and now abandoned, which in turn takes priority from U.S. patent application Ser. No. 09/571,325, filed on May 15, 2000 and now issued as U.S. Pat. No. 6,422,801, which takes priority from IL Patent Application No. 130018, filed on May 18, 1999."

FIELD OF THE INVENTION

The present invention generally relates to a system for loading a printing plate into a plate imaging device and specifically to a system for automatic loading of plates of various sizes into a plate setter or a printing plate imaging device.

BACKGROUND OF THE INVENTION

A variety of systems and applications use stacks of sheets or plates, which may be made of metal, paper, plastic and the like. Printing plates (hereinafter singly or collectively referred to as "plates") are typically stacked in a tray or similar container, which houses the plates and facilitates their protection, transportation and handling.

A specific system using plates generally uses trays having specific dimensions. Trays can usually be set to contain plates of various sizes, but all plates in the same tray are of one size. Usually the plates are manually removed from the cassette or the shipping container and inserted into the trays for use by the system, for example, a plate imaging system.

Plates are usually packed in the cassette with intermediate paper sheets, hereinafter referred to as 'separation paper'. The separation papers are disposed during loading into the imaging device by a mechanism such as described in U.S. Pat. No. 6,164,637 assigned to the common assignee of the present invention.

A typical conventional plate feeding system from a tray is shown schematically in FIG. 1. Plates 12 are supplied, within a tray 14, stacked one on top of the other with separation papers 16 between the plates.

Various mechanisms have been developed for removing a single plate 12 from the tray 14 and loading it using loading arm 18 to the loading plane 23 of the imaging system 20. Usually the feeding system includes a mechanism for disposing of the separation paper 16 into a paper bin 22 illustrated, for example.

One such system is described in U.S. Pat. No. 5,785,309 assigned to the common assignee of the present invention. The loading method described has the disadvantage in that, if a different plate size needs to be loaded for a subsequent operation, then the tray in use needs to be replaced by a tray containing the required plate size, or the tray itself needs to be replenished with plates of the required size. Replacing trays is a costly procedure and time consuming operation.

U.S. Pat. No. 5,367,360 to McIlwraith et al. describes a method for loading plates from a single tray. In this case, the cardboard shipping container is used as a tray and the plates are lifted and loaded vertically by a vacuum system.

The use of several trays with the same system is known in the art of copiers, for example, where paper is loaded selectively from different trays. The trays are stacked one on top of the other, each having a separate loading mechanism.

U.S. Pat. Nos. 5,655,452, 5,738,014 5,791,250, 5,788,455 describe an apparatus and method of loading plates from a plurality of trays into an imaging device. The trays are stacked one on top of the other and moved by an elevator mechanism to allow a loading arm to enter between the trays and pick-up a specific plate.

U.S. Pat. No. 4,984,260 to Koyama describes an automatic loader for films used in radiation diagnostics. This loader employs static staggered cassettes, a belt-type picking mechanism, which moves the films to an irradiation station, which is placed on top of the cassettes.

Trays containing printing plates are heavy and bulky, and moving such tray up and down requires complicated and expensive mechanism and is time consuming. There is, thus a widely recognized need for an automatic and efficient handling system of loading plates of various sizes to a plate imaging system, without the need to move trays.

Furthermore, the loading device may contain a large space for disposing the separation papers, a flat table for pre-exposure operations, such as punching registration holes in the plates, and a picking arm. It is desired that those units be packed into minimum floor space.

SUMMARY OF THE INVENTION

The present invention discloses a compact system for automatically feeding plates of various sizes from a group of staggered trays.

The present invention provides an automatic plate feeding system, which can be used to automatically feed plates of various sizes into a printing plate imaging device.

According to the present invention, there is provided a plate feeding system for grasping and moving a plate from a stack of plates housed in a plurality of trays. The stack of trays is static and staggered.

The system includes a plurality of trays staggered one on top of the other, wherein at least two of the plurality of trays contain plates of different sizes, the plates usually have separation papers interposed there between; and loading unit for loading plates from the trays and feeding them to an imaging device.

The loading unit may be an arm mechanism, which includes a plate grasping member for grasping the plate, sensors for distinguishing between plate and separation paper, and a separation paper disposing system. The grasping mechanism is movable perpendicularly to the arm by a vertical rod, which is movable by the carriage. The carriage is movable along the X-arm, which is typically parallel to the plates.

The trays are staggered in a way so that the grasping mechanism can be brought to each of the trays' openings, grasp a plate and feed it to the imagesetter, or grasp a separation sheet and dispose it into the paper bin.

According to some embodiments of the invention described below, the plate grasping member is an array of suction cups, and the feeding into the imagesetter is done in a general X direction to the right of the stack of trays.

In another configuration the X-Y arm mechanism is of the gantry type and includes a plate grasping member for grasping the plate, sensors and a separation paper disposing system. The grasping mechanism is movable in the orthogonal X-Y directions and rotatable. The X rail of the gantry type arm mechanism is typically parallel to the plates.

The trays are staggered in a way that the grasping mechanism can be brought to each of the tray's openings, grasp a plate and feed it to the imagesetter, or to grasp a separation sheet and to dispose it into the paper bin.

According to some embodiments of the present invention, the plate grasping member is an array of suction cups, which grasp the plate at its non-sensitive side, and the feeding into the imagesetter is done in a general X direction to the left of the stack of trays. A large paper disposal bin is available beneath the stack of trays.

In another embodiment the gantry structure is operated as an R-Θ arm, instead of the X-Y arm, described in the second embodiment.

Where the transfer of plates from the shipping container to the trays should be avoided, an open top shipping container can replace the lowest tray in the staggered structure. For unattended operations, which require a disposal of a large quantity of separation papers, an automatic replacement method of disposal bins is proposed.

BRIEF DESCRIPTION OF THE DRAWINGS

The present invention will be understood and appreciated more fully from the following detailed description taken in conjunction with the drawings in which:

FIGS. 2A, 2B, 2C and 2D schematically illustrate a multi-tray plate feeding system according to some embodiments of the present invention;

DESCRIPTION OF THE PREFERRED EMBODIMENT

Figure 1:
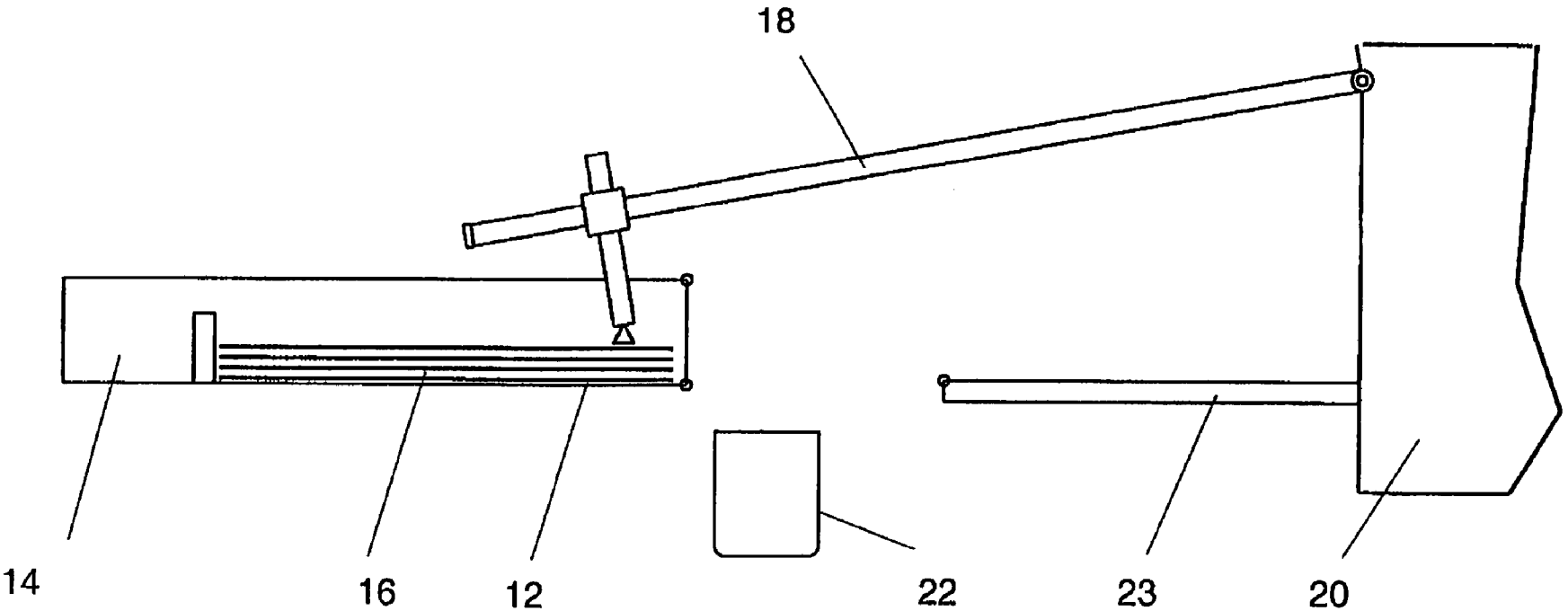
FIG.1 (PRIOR ART)
FIG. 1 schematically describes a prior art plate loading system from a single tray.
Figure 3:
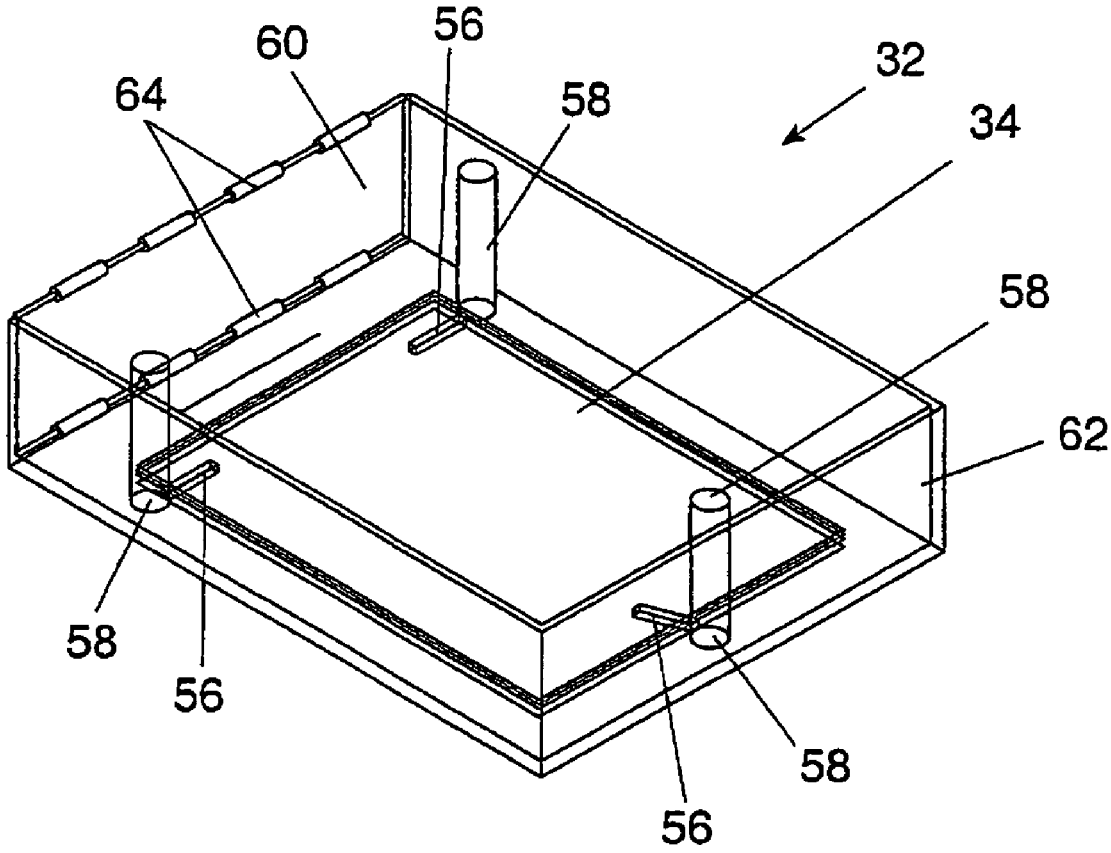
FIG. 3 schematically illustrates a tray for use with the staggered multi-tray plate loading system according to some embodiments of the present invention.

Reference is now made to FIGS. 2A-2D and 3. FIGS. 2A-2D illustrate the multi-tray plate loading system, generally designated 30, constructed and operative in accordance with an embodiment of the present invention. FIG. 3 schematically illustrates a typical tray 32, for use with the multi-tray plate loading system of FIG. 2. Each tray 32 is shown containing a plurality of plates 34, placed in the tray with their non-sensitive (no-emulsion) side up.

The multi-tray plate loading system 30 is especially suitable for the automatic loading of plates of various sizes into a plate setter or a printing plate imaging device, schematically illustrated, referenced 25.

The multi-tray plate loading system 30 includes a loading unit, which is a motorized arm mechanism, generally designated 36, pivotally connected to imaging device 25, for loading plates 34 from the trays 32 and feeding them to imaging device 25.

Referring now particularly to FIG. 2A, the multi-tray plate loading system 30 comprises a plurality of trays, referenced 32A, 32B and 32C holding stacks of plates referenced 34A, 34B and 34C respectively, of different sizes. Separation papers 38 are inserted to keep the plates apart from each other. The trays 32 are staggered one on top of the other. The offset distance between the trays is referenced W (FIG. 2A). In a typical application, W=70 mm.

Three trays are shown as an example only, but as will be appreciated, any number of trays can be mounted one on top of the other in a staggered manner.

Arm mechanism 36 is pivotal about a pivot point 40. During the plate feeding/loading operation, arm mechanism 36 is substantially parallel to the stack of plates 34 in the trays 32. The arm mechanism 36 is tiltable so as to allow access to the trays 32.

Arm mechanism 36 comprises an arm 42, a motorized carriage 44, which can be activated to move along the arm 42, and a vertical rod 46 connected to motorized carriage 44.

The motorized carriage 44 can be stopped automatically at any desired position along arm 42.

Vertical rod 46 is movable vertically (perpendicular to arm 42) through motorized carriage 44, and can be stopped automatically at any desired position. Vertical rod 46 comprises a bar 48 suitably attached to rod 46 at its lower end, and an array of suction cups 50 attached to bar 48.

The bar 48 also carries separation paper grippers (not shown) and sensors generally designated 70, which enable distinction between plate 34 and separation paper 38. The separation paper grippers may be any suitable known in the art devices, such as those described in U.S. Pat. No. 6,164,637, assigned to the common assignee of the present invention, described hereinabove.

The sensors 70 may be any suitable known in the art devices and will not be further described. The distinguishing sensors are preferably of the electrical contact type, as known in the art.

Motorized carriage 44 is coupled to a control unit 52, which is preferably coupled to the control unit of imaging device 25. Motorized carriage 44 is any suitable device, such as the commercially available model 2EC "Powerslide" of Thomson Ind. Industries. of New York, USA.

Also illustrated is the loading plane 54 for receiving the plates being fed to imaging device 25.

Reference is now also made to FIG. 3, which illustrates a typical tray 32. The base of the tray 32 comprises three adjustable pins 58, located in slots 56, the adjustment of which defines the overall dimensions of the plate 34 being stored. Two pins are located proximal to an open end, referenced 60, and one of the pins is located approximately in the center and proximal to the other end, referenced 62. The pins 58 are inserted in the required slot 56, prior to loading the tray 32 with plates 34. The tray 32 is open at the top, thus allowing for easy loading of plates 34. Usually the plates 34 are stacked with their imaging sensitive layer facing downwards. At open end 60, two rows of rollers 64, for guiding the plates 34 being fed, are suitably fitted.

The dimensions of the tray 32 are determined by the maximum size of plates to be loaded and the maximum number of plates to be stacked.

Figure 4:
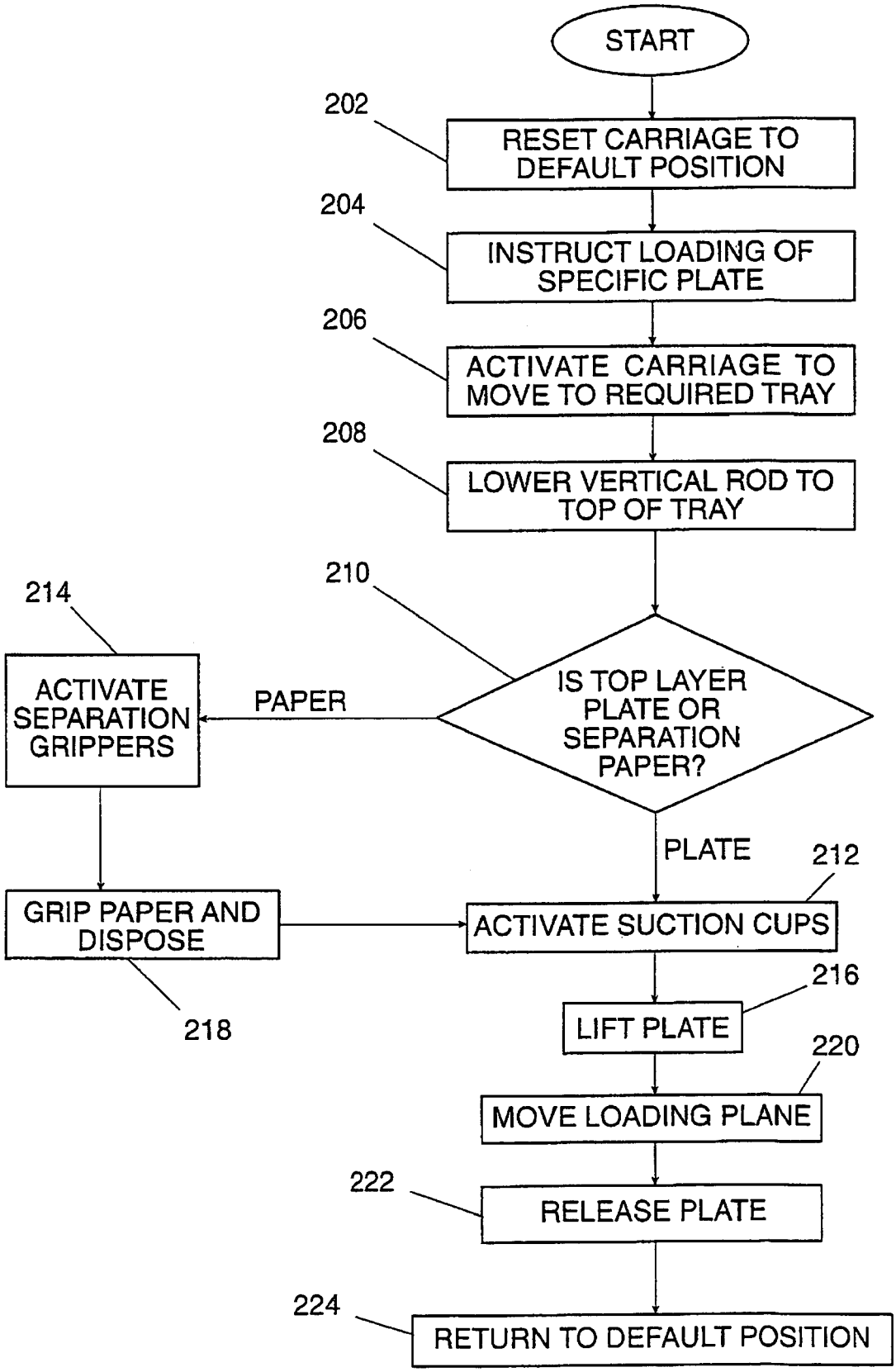
FIG. 4 is a flow chart illustration of a typical operation cycle of loading a plate to an imaging device out of a tray according to some embodiments of the present invention.

Reference is also made to FIG. 4, which is a flow chart illustration of a typical operation cycle of feeding a plate 34 to the imaging device 25.

As shown in the example of FIG. 2A, three trays 32 are stacked one on top of the other, and offset a distance W, as shown.

In the initial, non-activated mode, the motorized carriage 44 is located at its default position, that is at one end of arm 42, proximal to imaging device 25 (step 202). Vertical rod 46 is shown positioned at its highest point.

Upon receiving a command from control unit 52 (FIG. 2B), to load a plate of a specific size (step 204), the motorized carriage 44 is activated to move along the arm 42 towards the tray containing the required plate (say plate 34B in tray 32B)-(step 206).

Upon reaching the designated feeding position, motorized carriage 44 stops and vertical rod 46 descends until the suction cups 50 (together with separation paper grippers and distinguishing sensors 70), are in contact with the uppermost plate in the tray (step 208). The following step is conditioned by the existence of separation paper between the plates, which might not exist for certain plates.

The distinguishing sensors 70 indicate to the computerized control unit 52, whether the top layer is a separation paper 38 or a plate 34 (query box 210). Accordingly, depending on the upper layer, the computerized control unit 52 either activates the suction cups 50 (step 212) or the separation paper grippers (step 214).

On sensing contact with a plate 34, arm 42 is tilted so that the suction cups 50 are perpendicular to the plate 34. The suction cups 50 are then operated to grasp the plate 34 (step 212).

On the other hand, if the distinguishing sensors sense contact with separation paper 38 control unit 52 will activate the separation paper grippers 70 (step 214) to grip the separation paper 38 and then dispose of it into the paper bin 22 (step 218).

After disposing of the separation paper 38 (step 218), the plate loading sequence commences. As shown in FIG. 2C, vertical rod 46 is activated to move upwards a pre-determined amount, thus causing the suction cups 50 to lift the end of the plate 34 from the tray 32 (step 216).

As shown in FIG. 2D, the motorized carriage 44 is then activated to move (step 220) towards the loading plane 54 of the imaging device 25, dragging the plate 34 out of tray 32. The rollers 64 facilitate the smooth movement of the plates 34 over the edge of the tray 32.

On reaching the loading plane 54, rod 46 moves downwards and releases the plate 34 (step 222). The arm mechanism 36 is then returned to its initial position (step 224). The plate 34 is then fed into the imaging device 25 by methods known in the art, for example, U.S. Pat. No. 5,488,906 assigned to the common assignee of the present invention.

Figure 5:
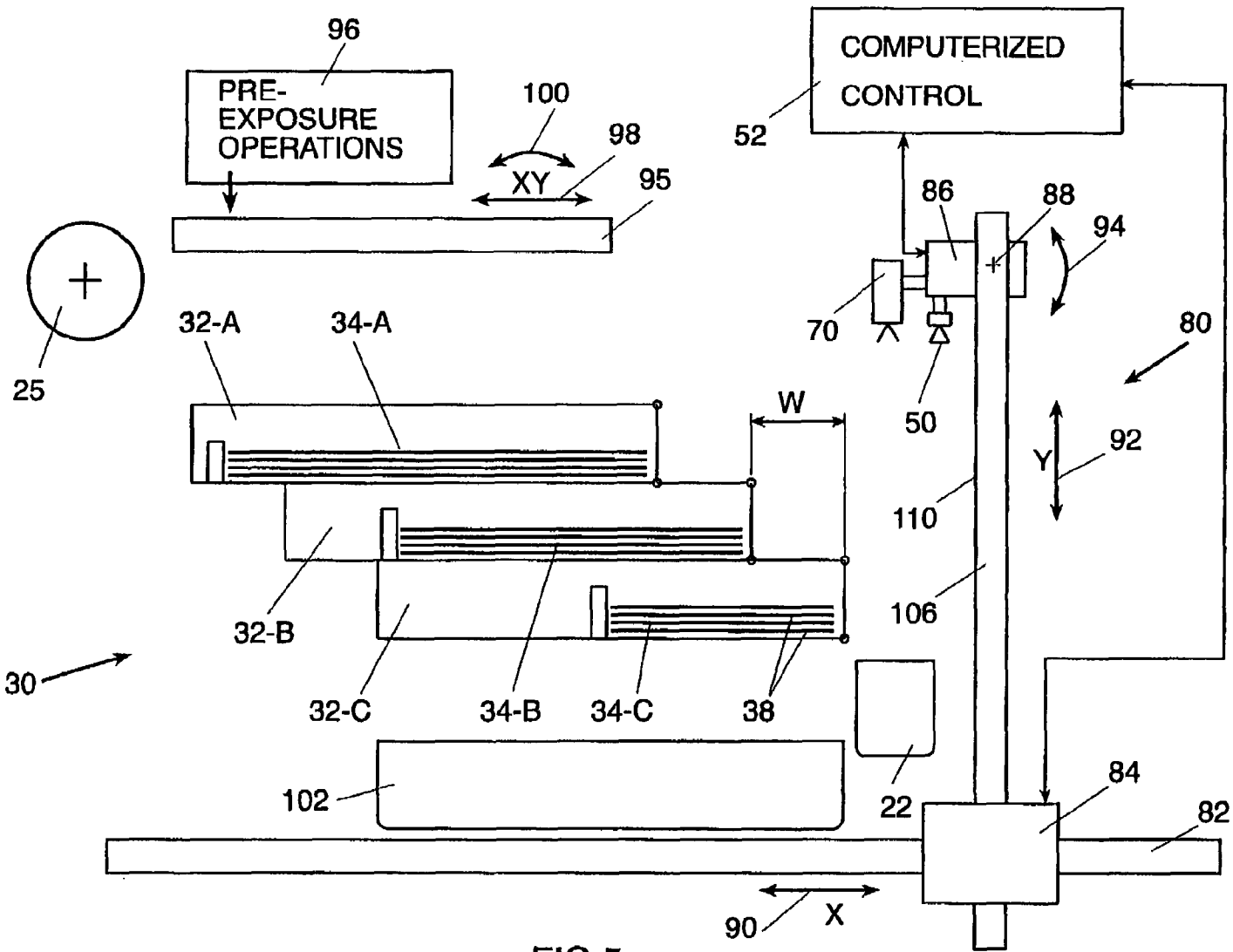
FIGS. 5, 6, and 7 schematically illustrate a multi-tray plate feeding system according to some embodiments of the present invention.

Another configuration of a staggered tray printing plate loading system is shown in FIG. 5. The loading system of FIG. 5 occupies minimum floor space, compared to the loading system of FIG. 2A. This configuration is particularly useful when floor space is at premium, and handling of the plate at its non-sensitive side is desirable.

Referring now particularly to FIG. 5, the multi-tray plate loading system 30 comprises a plurality of trays, referenced 32A, 32B and 32C holding stacks of plates referenced 34A, 34B and 34C respectively, of different sizes. Separation papers 38 are inserted to keep the plates apart from each other. The trays 32 are staggered one on top of the other. The offset distance between the trays is referenced W. In a typical application, W=70 mm.

Three trays are shown as an example only, but as will be appreciated, any number of trays can be mounted one on top of the other in a staggered manner.

A loading table 95 is placed above the staggered trays 32, and the imaging device 25 is generally placed at the rear of the loading system 30.

Loading unit 80 is of a gantry type, including: two rails 82, substantially parallel to the stack of plates 34 in the trays 32, mounted at the two sides of the staggered trays, and a "bridge" 110 having two substantially vertical rails 106, on which a motorized carriage 86 can move in the "Y" direction 92.

The motorized carriage 86 includes a horizontal bar (not shown) supported between the two rails 106. The carriage 86 and attached bar can be stopped automatically at any desired position along rails 106. The horizontal bar carries an array of suction cups 50, separation paper grippers (not shown) and sensors generally designated 70, which enable distinction between plate 34 and separation paper 38. The separation paper grippers may be any suitable known in the art, such as those described in U.S. Pat. No. 6,164,637, assigned to the common assignee of the present invention, described hereinabove.

The sensors 70 may be any suitable known in the art devices and will not be further described. The distinguishing sensors are preferably of the electrical contact type, as known in the art.

Motorized carriage 86 can rotate to an angle 94, having a rotation center 88 on rail 106.

Motorized carriage 86 is coupled to a computerized control unit 52, which is preferably coupled to the control unit of imaging device 25. Motorized carriage 86 is any suitable device known in the art.

The gantry "bridge" structure 110 is coupled to rails 82 by another motorized carriage 84, which enables the movement of gantry "bridge" 110 in the "X" direction 90. The gantry "bridge" 110 can be stopped automatically at any desired position along rails 82. Motorized carriage 84 is any suitable device, such as the commercially available model 2EC "Powerslide" of Thomson Ind. Industries of New York, USA.

Loading table 95 is tiltable at angle 100 and can optionally have a separate X-Y mechanism 98 for handling the plate on the loading table during pre-exposure operations and subsequently loading that plate to imaging device 25. Pre-exposure operations 96 can include, for example punching of the plate (not shown) for registration purposes. Independent handling of the plate by loading table 95 means that the main loading mechanism 80 can be more efficient in paper 38 disposable and plate 34 selection and feeding functions, which translates finally to a higher plate per hour capacity of the entire loading system 30.

The non-used space available under the stack of trays 32 is used for a large paper disposal bin 102. The disposed papers 38 can be spread in the bin 102 in an orderly way, which maximizes the usage of the bin.

Reference is made again to FIG. 4, which is a flow chart illustration of a typical operation cycle of feeding a plate 34 to the imaging device 25.

As shown in the example of FIG. 5, three trays 32 are stacked one on top of the other, and offset a distance W, as shown.

In the initial, non-activated mode, the motorized carriage 86 is located at its default position, that is at the top of gantry "bridge" 110, the "bridge" itself is at the right extreme of the stack of static trays 32 (step 202).

Figure 6:
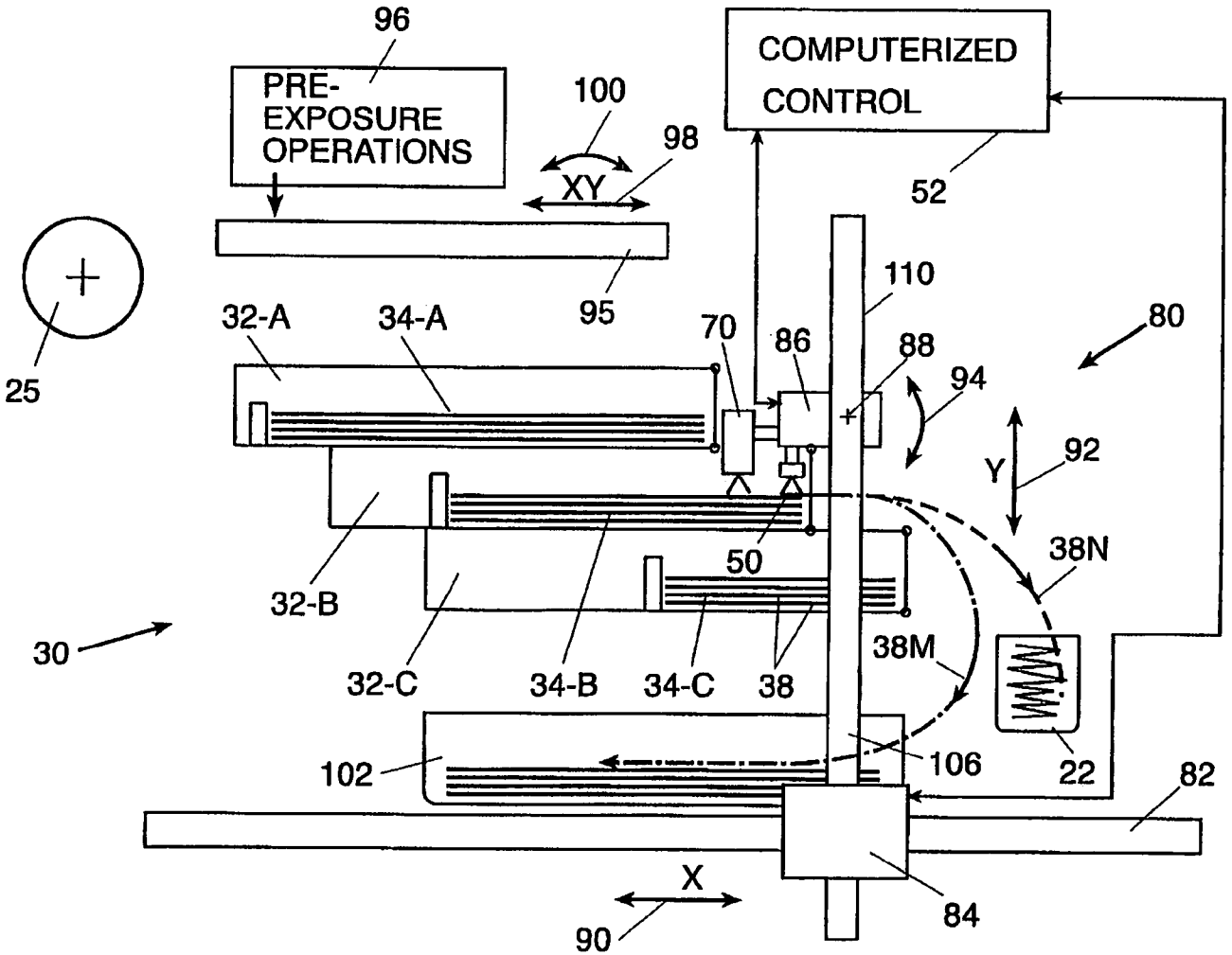

Upon receiving a command from control unit 52 (FIG. 6), to load a plate of a specific size (step 204), both motorized carriages 86 and 84 are activated to move along rails 106 and 82 respectively, towards the tray containing the required plate, say plate 34B in tray 32B-(step 206).

Upon reaching the designated feeding position, both motorized carriages 86 and 84 stop and carriage 86 descends until the suction cups 50 (together with separation paper grippers and distinguishing sensors 70), are in contact with the non-sensitive side of the uppermost plate in the tray (step 208). The method of picking the plate 34 and moving it to the loading table 95 is done on the non-sensitive (no emulsion) side of the plate, with the result of minimizing risk of damage to the sensitive side of the plate.

The following step is conditioned by the existence of separation paper 38 between the plates, which might not exist for certain plates.

The distinguishing sensors 70 indicate to the computerized control unit 52, whether the top layer is a separation paper 38 or a plate 34 (query box 210). Accordingly, depending on the upper layer, the computerized control unit 52 either activates the suction cups 50 (step 212) or the separation paper grippers (step 214).

On sensing contact with a plate 34, the suction cups 50 are then operated to grasp the plate 34 at its non-sensitive side (step 212).

On the other hand, if the distinguishing sensors sense contact with separation paper 38, control unit 52 will activate the separation paper grippers (step 214) to grip the separation paper 38 and then dispose of it into either paper bin 22 or paper bin 102, whichever is installed in the specific system 30 (step 218). Paper bin 102, installed in the empty space below the stack of trays 32, has dimensions exceeding the largest plate useful in system 30, permitting orderly disposal of separation paper sheets 38 one on top of the other. This method represents a highly efficient way of paper disposal. Paper bin 22 can be of the type described in U.S. Pat. No. 5,771,794 assigned to the common assignee of this invention.

Figure 7:
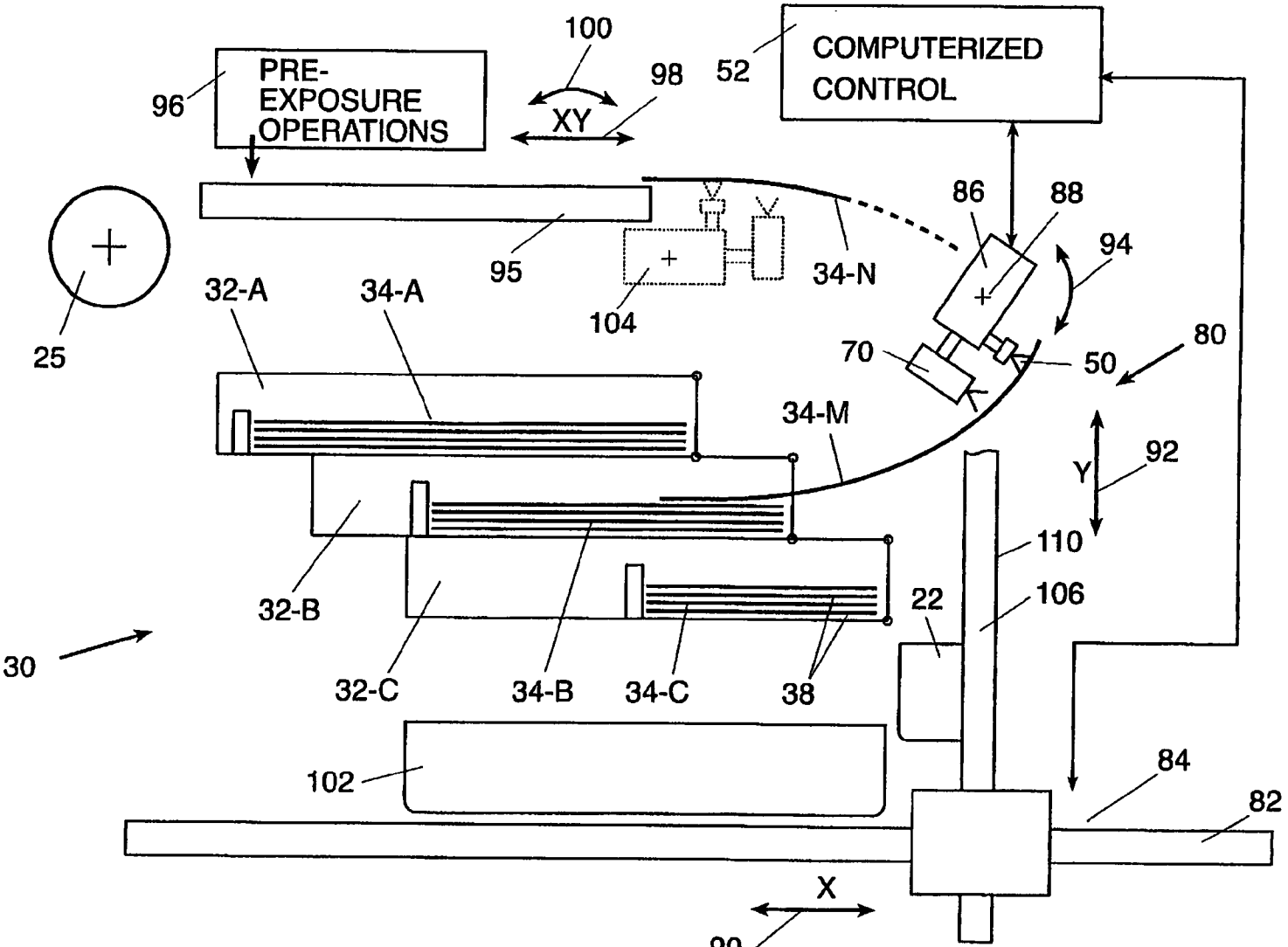

After disposing of the separation paper 38 (step 218), the plate loading sequence commences. As shown in FIG. 7, motorized carriage 86 is activated to move and rotate on axis 88, thus causing the suction cups 50 to lift the end of the plate 34 from the tray 32 and move the plate to position 34-M (step 216). Motorized carriage 86 is programmed to move further and rotate to position 104, dragging the plate up-side-down to position 34-N. Further movement to the left in the X direction 90 disposes the plate on the loading table 95 (step 220), whereas the non-sensitive side of plate 34 is in contact with loading table 95. If the loading table 95 is equipped with an independent handling mechanism for the plate, the plate is released from suction cups 50 (step 222) and the motorized carriage 86 returns to its default position as shown in FIG. 5 (step 224), or moved immediately to pick up a new plate from a given tray 32 as shown, for example, in FIG. 6 (steps 204 and 206).

Figure 8:
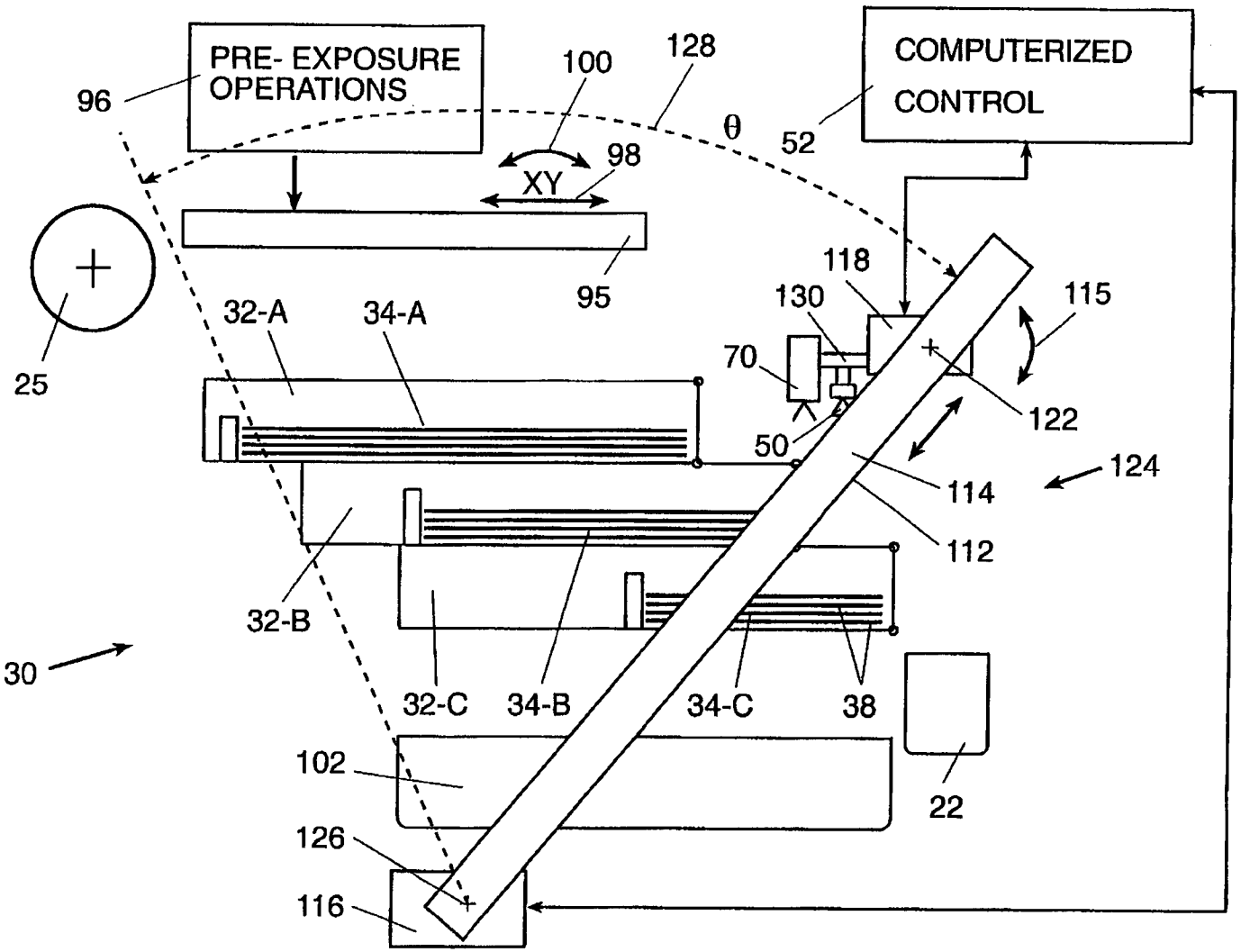
FIG. 8 schematically illustrates another configuration of a multi-tray R-Θ plate feeding system, constructed and operative in accordance with some embodiments of the present invention.

Another configuration of a staggered tray printing plate loading system 30 is shown in FIG. 8. This configuration, has the same advantages as the one shown in FIG. 5, and is particularly useful when floor space is at premium, and handling of the plate at its non-sensitive side is desirable.

Referring now particularly to FIG. 8, the multi-tray plate loading system 30 comprises a plurality of trays, referenced 32A, 32B and 32C holding stacks of plates referenced 34A, 34B and 34C respectively, of different sizes. Separation papers 38 are inserted to keep the plates apart from each other. The trays 32 are staggered one on top of the other. The offset distance between the trays is referenced W. In a typical application, W=70 mm.

Three trays are shown as an example only, but as will be appreciated, any number of trays can be mounted one on top of the other in a staggered manner.

The loading table 95 is placed above the staggered trays 32, and the imaging device 25 is generally placed at the rear of the loading system 30.

Loading unit 124 is of a R-Θ gantry type, including: two rails 114, which are part of a bridge structure (not shown), pivoted at center 126 including a motorized unit 116, as known in the art, which is designed to move loading unit 124 to an angle Θ marked 128. The motorized unit 116 can be stopped automatically at any desired angle within Θ. A motorized unit 118, as known in the art, can move along rails 114 in direction R marked 120, with an attached bar 130, which is substantially parallel to the stack of plates 34. The carriage 118 including the attached bar can be stopped automatically at any desired position along rails 114. The horizontal bar 130 carries an array of suction cups 50, separation paper grippers (not shown) and sensors generally designated 70, which enable distinction between plate 34 and separation paper 38. The separation paper grippers may be any suitable known in the art, such as those described in U.S. Pat. No. 6,164,637, assigned to the common assignee of the present invention, described hereinabove.

The sensors 70 may be any suitable known in the art devices and will not be further described. The distinguishing sensors are preferably of the electrical contact type, as known in the art.

Motorized carriage 118 can rotate to an angle 116, having a rotation center 122 on rail 114.

The operation of arm mechanism 124 is essentially similar to that of loading unit 80 as described in FIG. 5, 6, 7, with the exception that R-Θ movements are replacing X-Y movements.

The sequence of operations described in FIG. 4 is relevant also to the multi-tray plate loading system 30 having arm mechanism 124 as shown in FIG. 8, with the exception that R-Θ movements are replacing X-Y movements.

Figure 9:
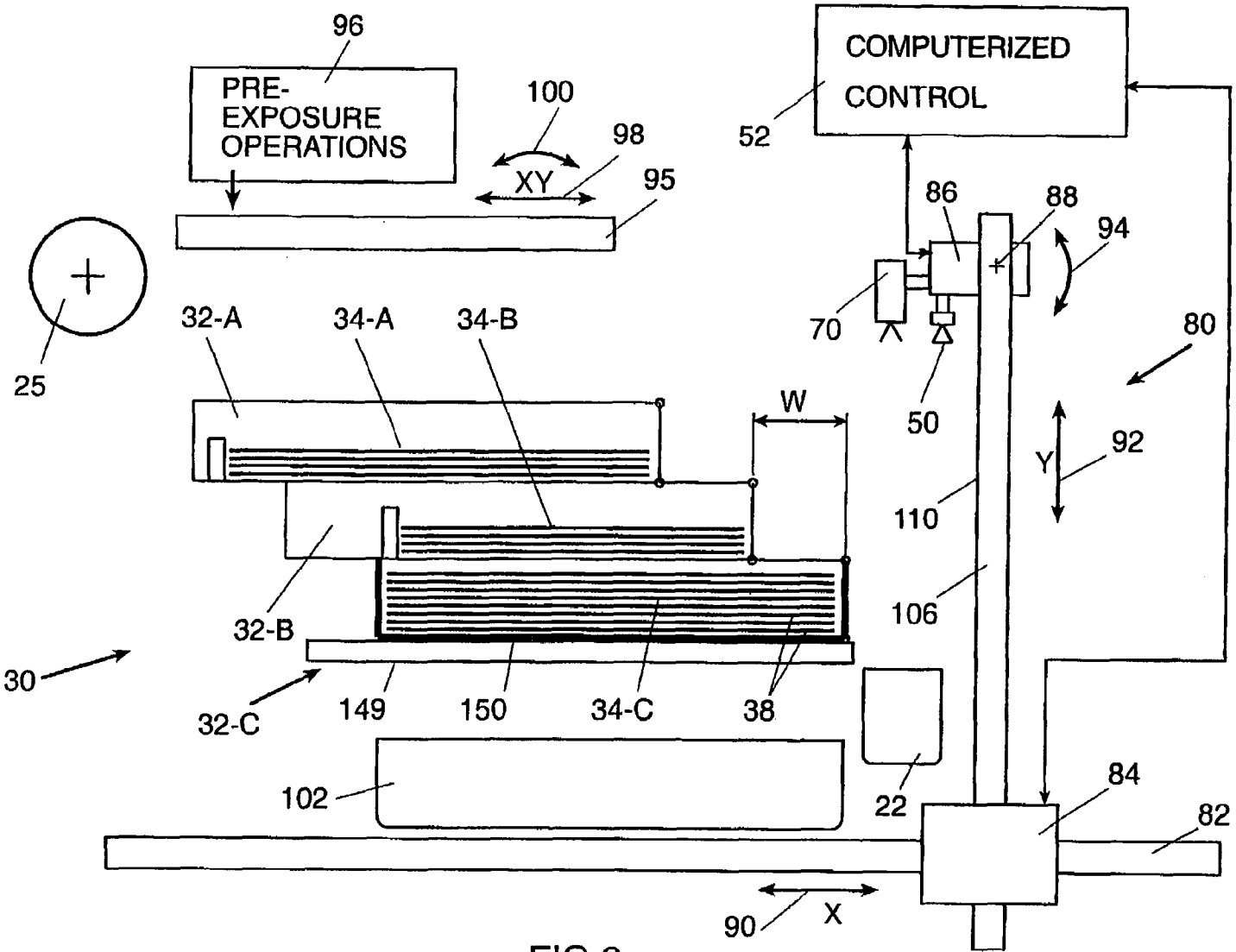
FIG. 9 schematically illustrates the option of using the plates shipping container instead of the lowest tray in the staggered multi-tray system according to some embodiments of the present invention.

In certain applications it is advisable to use the original shipping container in the plate loading system 30, avoiding the time consuming and delicate operation of transferring the plates from the container into a tray 32. This application is shown in FIG. 9, where the shipping container 150 includes plates 34-C and separation papers 38. The container 150 has substantially the dimensions of the stack of plates stored in it. In this application container 150 replaces the lowest tray 32-C, and is inserted on suitable rails 149 to permit the offset distance W between trays. The operation of picking a plate from container 150 is identical to the same operation out of a tray 32.

In certain unattended applications, a large quantity of separation papers is removed, above and beyond the capacity of a single paper bin 22 and even paper bin 102. For such applications, it is advisable to use the solution described in FIG. 10.

Figure 10:
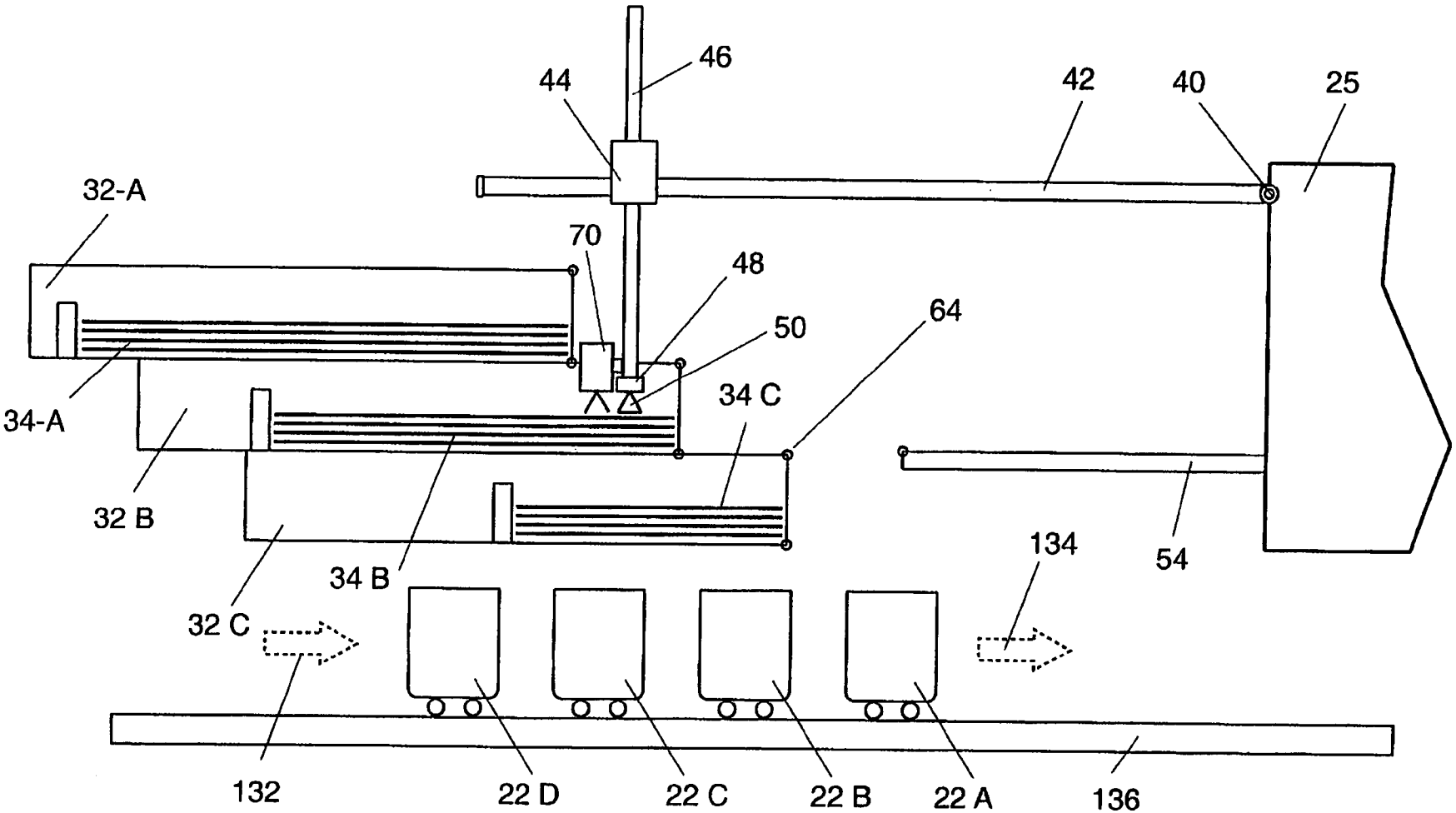
FIG. 10 schematically illustrates the option of using one or more paper disposal bins according to some embodiments of the present invention.

In FIG. 10 a group of wheeled paper bins 22 is arranged on rail 136, where the bins can be advanced automatically in direction 34, as known in the art, and stopped at a predetermined position. Once bin 22A is full it is moved automatically forward in direction 134 and is replaced by paper bin 22B. A number of reserve bins, for example, 22B, 22C, 22D can be prepared for automatic replacement. Photoelectric signalization, as known in the art, can be used to indicate the maximum paper capacity of each bin 22, and the computerized control unit 52 can do the movement automation.

The operator of system 30 can periodically remove full bins 22 from rail 136 in direction 134, empty the bins and return the empty bins to the waiting line in direction 132. This method of operation is particularly useful for long-term automatic and unattended operation of the entire imaging system, including the imaging device 25 and plate loading system 30.

It will be appreciated by persons skilled in the art that the present invention is not limited to what has been particularly shown and described hereinabove. Rather the scope of the present invention is defined only by the claims which follow:

What is claimed is:

1. A printing plate feeding system comprising:

a plurality of trays staggered one on top of the other;

a loading unit having an arm mechanism to load imaging plates from said plurality of trays onto a loading table of an imaging device, said loading table positioned above said trays;

wherein said loading unit is configured to handle said plates at a non-sensitive side of the plates;

wherein said loading unit comprises:

a horizontal bar rotatable around its longitudinal axis and having one or more suction cups attached thereto to pick up said plates; and two vertical rails to carry said horizontal bar, said vertical rails rotatable about an axis parallel to and below said longitudinal axis.

2. A printing plate feeding system comprising:

two or more paper bins; a plurality of trays staggered one on top of the other;

a loading unit having an arm mechanism to load imaging plates from said plurality of trays onto a loading table of an imaging device, said loading table positioned above said trays;

one or more rails positioned below the lowest of said trays to carry said paper bins; and wherein said loading unit is configured to handle said plates at a non-sensitive side of the plates.

3. A method for automatically loading printing plates comprising:

positioning a loading unit having one or more suction cups and one or more grippers attached thereto in proximity to one of a plurality of staggered trays each having imaging plates with separation papers interposed there between, said plates having a sensitive surface and a non-sensitive surface and are positioned with the non-sensitive surface facing said suction cups;

activating a sensor to determine if a surface directly below said suction cups is the non-sensitive surface of one of said plates; if so lifting said one of said plates with said suction cups;

placing the lifted plate onto a loading table positioned above said trays with the non-sensitive surface of said plate facing said loading table;

wherein when said sensor determined that said surface directly below said suction cups is a surface of one of said separation papers, gripping said one of said papers; and disposing said one of said separation papers into a disposal bin; and wherein when said disposal bin is filled with said papers, automatically moving said disposal bin to advance an additional disposal bin to a predefined position.

4. A printing plate feeding system comprising:

a plurality of trays staggered one on top of the other;

a loading unit having an arm mechanism to load imaging plates from said plurality of trays onto a loading table of an imaging device, said loading table positioned above said trays;

wherein said loading unit is configured to handle said plates at a non-sensitive side of the plates; and wherein said arm mechanism is a gantry type R-Θ arm mechanism.

5. A printing plate feeding system comprising:

a plurality of trays staggered one on top of the other; and a loading unit having an arm mechanism to load imaging plates from said plurality of trays onto a loading table of an imaging device, said loading table positioned above said trays, wherein said loading unit is configured to handle said plates at a non-sensitive side of the plates, wherein said loading unit comprises: a horizontal bar rotatable around its longitudinal axis and having one or more suction cups attached thereto to pick up said plates and two vertical rails to carry said horizontal bar, said vertical rails rotatable about an axis parallel to and below said longitudinal axis.

6. A printing plate feeding system comprising:

a plurality of trays staggered one on top of the other;

a loading unit having an arm mechanism to load imaging plates from said plurality of trays onto a loading table of an imaging device, said loading table positioned above said trays, wherein said loading unit is configured to handle said imaging plates at a non-sensitive side of the plates;

two or more paper bins; and one or more rails positioned below the lowest of said trays to carry said paper bins.

7. A method for automatically loading printing plates comprising:

positioning a loading unit having one or more suction cups and one or more grippers attached thereto in proximity to one of a plurality of staggered trays, each having imaging plates with separation papers interposed there between, said imaging plates having a sensitive surface and a non-sensitive surface which are positioned with the non-sensitive surface facing said suction cups;

lifting one of said imaging plates with said suction cups;

placing the lifted imaging plate onto a loading table positioned above said trays with the non-sensitive surface of said plate facing said loading table;

gripping one of said papers when a sensor determined that said surface directly below said suction cups is a surface of one of said separation papers;

disposing said one of said separation papers into a disposal bin; and moving said disposal bin to advance an additional disposal bin to a predefined position when said disposal bin is filled with said papers.

* * * * *